US006978877B2

(12) United States Patent
Spatafora et al.

(10) Patent No.: US 6,978,877 B2
(45) Date of Patent: Dec. 27, 2005

(54) AUTOMATIC MACHINE FOR PROCESSING ARTICLES AND HAVING A POSITION DETECTING DEVICE WITH HALL-EFFECT SENSORS

(75) Inventors: Mario Spatafora, Granarolo (IT); Bruno Tommasini, Pianoro (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/901,001

(22) Filed: Jul. 28, 2004

(65) Prior Publication Data

US 2005/0061611 A1 Mar. 24, 2005

(30) Foreign Application Priority Data

Aug. 1, 2003 (IT) ..... BO2003A0470

(51) Int. Cl.[7] ..... B65G 43/00

(52) U.S. Cl. ..... 198/341.01; 198/460.1; 198/476.1; 198/478.1

(58) Field of Search ..... 198/341.01, 341.02, 198/396, 476.1, 482.1, 478.1, 803.14, 867.12, 198/460.1

(56) References Cited

U.S. PATENT DOCUMENTS 5,092,450 A * 3/1992 Schommartz et al. .... 198/460.1
5,188,217 A * 2/1993 Bruno ..... 198/803.9
5,724,786 A 3/1998 Singh et al.
5,906,262 A * 5/1999 Miki ..... 198/341.02
6,032,845 A * 3/2000 Piccone et al. ..... 198/832.1
6,152,289 A * 11/2000 Wark et al. ..... 198/460.1
6,168,003 B1 * 1/2001 Wacker ..... 198/341.01
6,820,736 B2 * 11/2004 Itoh et al. ..... 198/781.01
2002/0005715 A1 1/2002 Sato

FOREIGN PATENT DOCUMENTS

WO 00/64791 11/2000
WO 02095334 11/2002

OTHER PUBLICATIONS

English Abstract of WO 02/095334 dated Nov. 28, 2002.

* cited by examiner

*Primary Examiner*—James R. Bidwell
(74) *Attorney, Agent, or Firm*—Ladas and Parry LLP

(57) ABSTRACT

An automatic machine for processing articles, and having a conveyor which feeds the articles along a path in a given feed direction and has a movable member; and a reading device for determining the position of the movable member; the reading device cooperates with a permanent magnet housed inside the movable member and positioned with its polar axis perpendicular to the feed direction, and has two linear Hall-effect sensors arranged side by side parallel to the feed direction so as to have zero sensitivity in a direction parallel to the feed direction; and the instant in which the movable member is in a definite detection position with respect to the reading device is detected by determining the instant in which the output signal of the Hall-effect sensor downstream with respect to the travelling direction of the movable member inverts.

14 Claims, 3 Drawing Sheets

AUTOMATIC MACHINE FOR PROCESSING ARTICLES AND HAVING A POSITION DETECTING DEVICE WITH HALL-EFFECT SENSORS

The present invention relates to an automatic machine for processing articles.

The present invention may be used to particular advantage in an automatic cigarette packing machine, to which the following description refers purely by way of example.

BACKGROUND OF THE INVENTION

An automatic cigarette packing machine comprises a number of conveyors, each for feeding cigarettes successively along a respective path, and having a number of respective movable members. Since it is often necessary to determine the exact instant the movable members move into a given position, e.g. so as to correctly time operation of an operating device interacting with the cigarettes carried by the movable members, the automatic machine comprises one or more reading devices, each for determining the position of the movable members of a respective conveyor.

Reading devices of the above type are typically optical, and comprise a beam emitter, and a receiver connected to the emitter and for determining the instant the beam is interrupted by passage of a movable member. Optical reading devices, however, are relatively inaccurate, and require frequent cleaning to prevent tobacco powder from settling on the emitter or receiver and so impairing operation of the device.

SUMMARY OF THE INVENTION

It is an object of the present invention to provide an automatic machine for processing articles, designed to eliminate the aforementioned drawbacks, and which, in particular, is cheap and easy to produce.

According to the present invention, there is provided an automatic machine for processing articles, as claimed in Claim 1 and, preferably, in any one of the following Claims depending directly or indirectly on Claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
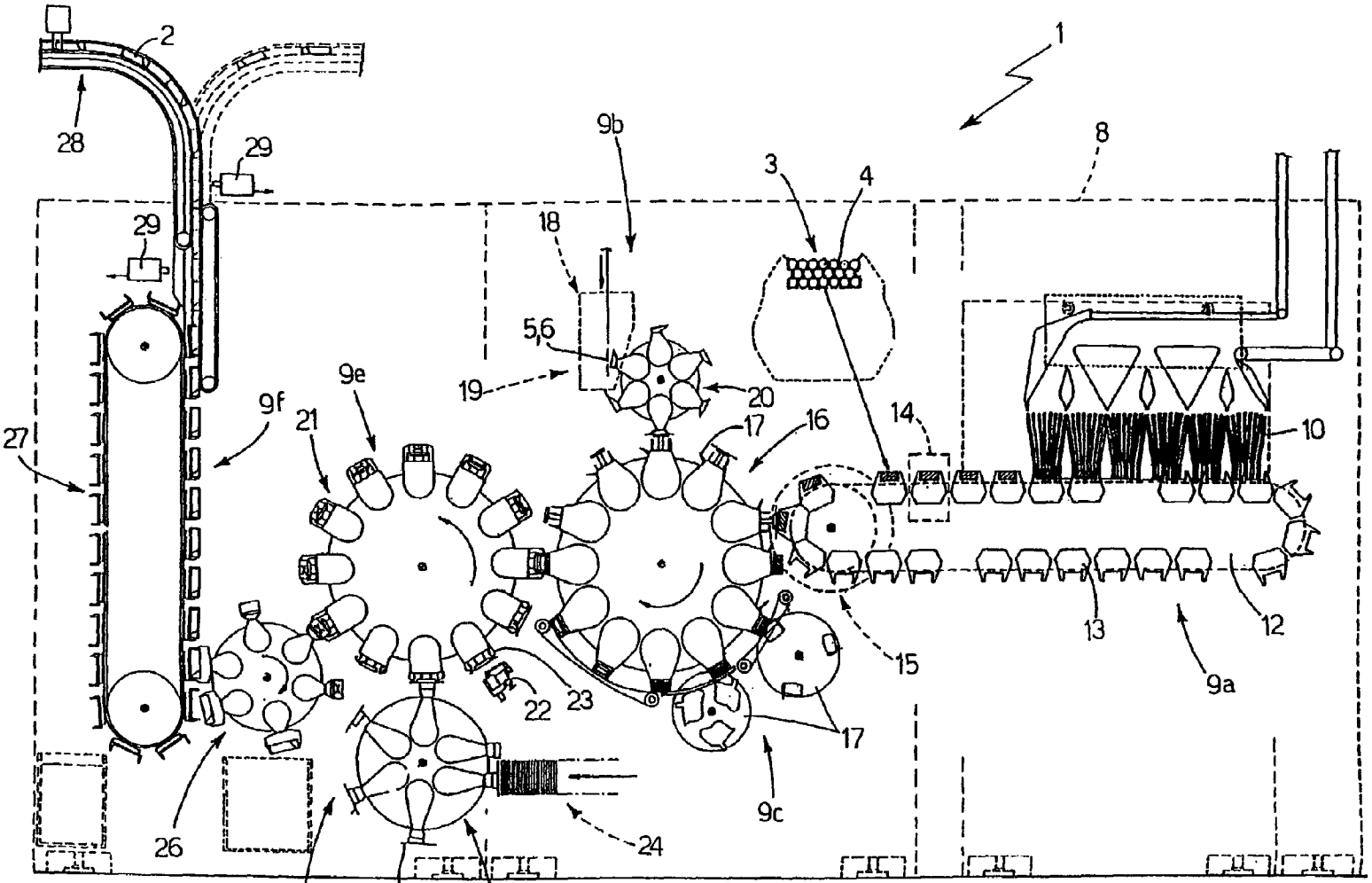
FIG. 1 shows a schematic front view of an automatic cigarette packing machine in accordance with the present invention.

Number 1 in FIG. 1 indicates as a whole an automatic machine for producing rigid, hinged-lid packets 2 of cigarettes. Each packet 2 comprises an orderly group 3 of cigarettes 4 wrapped in a sheet 5 of foil wrapping material; a collar 6 folded about group 3, over sheet 5 of wrapping material; and a blank 7 folded about group 3.

Machine 1 is a substantially known type, and comprises a frame 8, shown by the dash line in FIG. 1, supporting a number of processing stations 9. More specifically, machine 1 comprises six processing stations 9: a station 9*a* for forming groups 3 of cigarettes 4; a station 9*b* for supplying sheets 5 of foil wrapping material and collars 6; a station 9*c* for folding sheets 5 of wrapping material and collars 6 about respective groups 3; a station 9*d* for supplying blanks 7; a station 9*e* for folding blanks 7 about respective groups 3 (over sheets 5 of wrapping material and collars 6); and an output station 9*f* for packets 2.

Station 9*a* for forming groups 3 of cigarettes 4 comprises a hopper 10 for cigarettes 4; and an extracting device 11 (FIG. 2) for extracting groups 3 of cigarettes 4 from hopper 10, and feeding groups 3 to a forming conveyor 12 having trains of pockets 13, each for receiving a respective group 3 of cigarettes 4. A control station 14, and a transfer wheel 15 connected to forming station conveyor 12, are also provided at forming station 9*a*.

Station 9*c* for folding sheets 5 of wrapping material and collars 6 about respective groups 3 comprises a wrapping wheel 16 which receives groups 3 from transfer wheel 15; and a number of folding members 17 carried by or outside wheel 16. Station 9*b* for supplying sheets 5 of foil wrapping material and collars 6 comprises a feed conveyor 18; a cutting device 19; and a feed wheel 20 for feeding sheets 5 of wrapping material and collars 6 together to wrapping wheel 16.

Station 9*e* for folding blanks 7 about respective groups 3 (over sheets 5 of wrapping material and collars 6) comprises a packing wheel 21 which receives groups 3 from wrapping wheel 16; a gumming device 22; and a number of folding members 23 carried by wheel 21. Station 9*d* for supplying blanks 7 comprises a horizontal store 24 for blanks 7; and a feed wheel 25 for feeding blanks 7 to packing wheel 21. Finally, output station 9*f* for packets 2 comprises a transfer and reject wheel 26; a drying conveyor 27; a gumming device (not shown); an output conveyor 28; and optical control devices 29.

Figure 2:
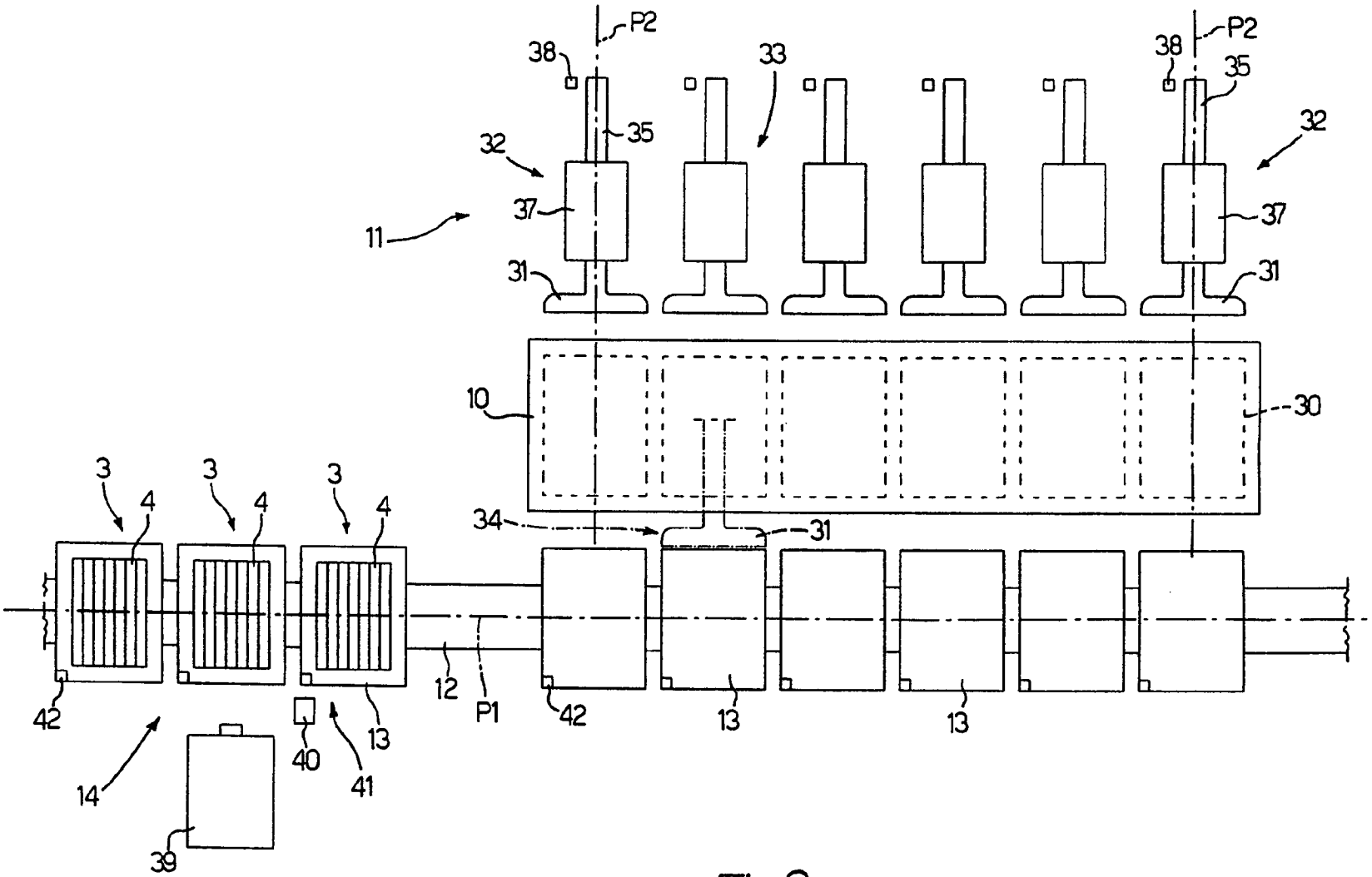
FIG. 2 shows a schematic plan view, with parts removed for clarity, of a cigarette group forming station of the FIG. 1 machine.
Figure 3:
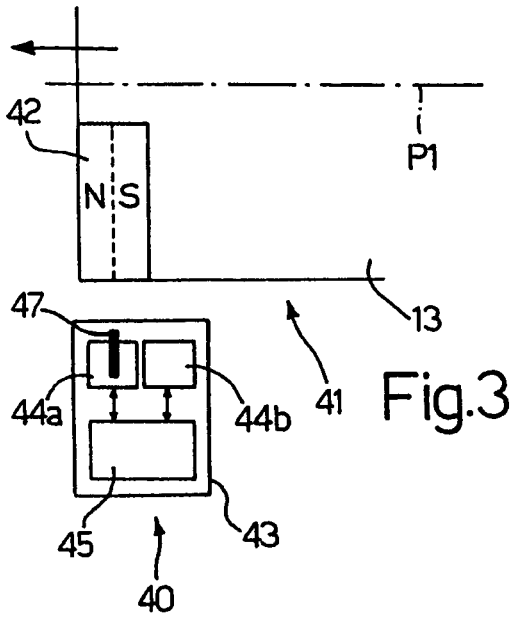
FIG. 3 shows an operating diagram of a first position detecting device at the FIG. 2 forming station.
Figure 4:
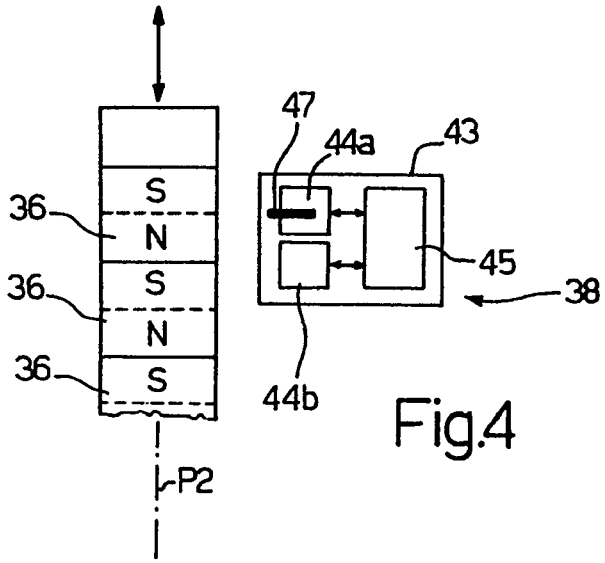
FIG. 4 shows an operating diagram of a second position detecting device at the FIG. 2 forming station.

As shown in FIG. 2, hopper 10 comprises six outlets 30 aligned along a path P1 of forming conveyor 12. Extracting device 11 extracts a respective group 3 of cigarettes 4 from each outlet 30, and feeds group 3 into a corresponding pocket 13 facing and aligned with outlet 30. For each outlet 30, extracting device 11 comprises a pusher 31 powered by a respective linear electric motor 32 to move cyclically along a straight path P2 between a rest position 33 (shown by the continuous line) and an extraction position 34 (shown by the dash line). Each linear electric motor 32 comprises a movable rod 35 supporting pusher 31 and having a number of permanent magnets 36 (shown in FIG. 4); and a fixed armature 37 supporting rod 35 in sliding manner. And each rod 35 is associated with a respective reading device 38 for determining the position of rod 35 along respective path P2, and in particular for determining when rod 35 is in rest position 33.

Control station 14 is located along path P1, downstream from hopper 10 in the travelling direction of forming conveyor 12, and a television camera 39 at the control station checks the end fill of cigarettes 4 in each pocket 13. Television camera 39 is associated with a reading device 40 identical with reading device 38, and which determines the instant a pocket 13 is in a definite detection position 41 with respect to television camera 39, so as to generate a sync signal by which to synchronize television camera 39. To ensure correct operation of reading device 40, each pocket 13 houses a respective permanent magnet 42 positioned with its polar axis, i.e. the axis separating the south pole from the north pole, perpendicular to path P1 of pocket 13.

Reading device 40 comprises a tubular body 43 housing two linear Hall-effect sensors 44 positioned side by side parallel to path P1, so as to have zero sensitivity in a direction parallel to path P1, and maximum sensitivity in a direction perpendicular to path P1. More specifically, one Hall-effect sensor 44*a* is located downstream with respect to the travelling direction of magnet 42, and the other Hall-effect sensor 44*b* is located upstream with respect to the travelling direction of magnet 42. Tubular body 43 also houses a control unit 45 for detecting the instant a magnet 42, and therefore relative pocket 13 supporting magnet 42, is in detection position 41.

Figure 5:
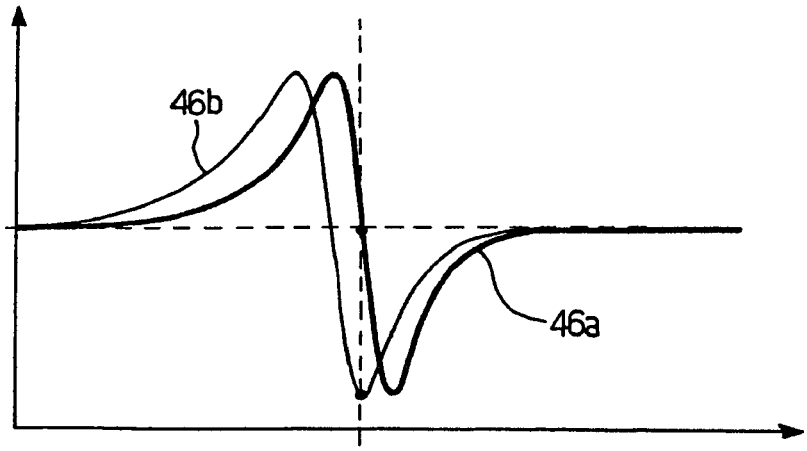
FIG. 5 shows a time graph of the signals supplied by the sensors of the FIGS. 3 and 4 position detecting devices.

When a magnet 42 is relatively far from Hall-effect sensors 44, the output signals 46 (FIG. 5) of Hall-effect sensors 44 are substantially constant and equal to a reference value; and when magnet 42 travels past a Hall-effect sensor 44, the output signal 46 of Hall-effect sensor 44 assumes a sinusoidal pattern with respect to the reference value, with an inversion instant, i.e. an instant in which output signal 46 crosses the reference value, coincident with the instant in which the polar axis of magnet 42 is in an intermediate position with respect to Hall-effect sensor 44.

Control unit 45 determines the instant a magnet 42, and therefore relative pocket 13 supporting magnet 42, is in detection position 41 by determining the instant output signal 46*a* of Hall-effect sensor 44*a* inverts, and using the output signal 46*b* of Hall-effect sensor 44*b* to enable detection of the instant magnet 42 is in detection position 41. In other words, as a pocket 13 supporting relative magnet 42 travels past, control unit 45 detects a marked variation in output signal 46*b* of Hall-effect sensor 44*b* upstream in the travelling direction of magnet 42, and is therefore activated to determine the instant a magnet 42, and therefore relative pocket 13 supporting magnet 42, is in detection position 41 by determining the instant output signal 46*a* of Hall-effect sensor 44*a* downstream in the travelling direction of magnet 42 inverts.

In an alternative embodiment, control unit 45 determines the instant magnet 42 is in detection position 41 by determining the instant output signal 46*b* of Hall-effect sensor 44*b* upstream in the travelling direction of magnet 42 inverts.

In a preferred embodiment, the two Hall-effect sensors 44 are located such a distance apart that output signal 46*b* of Hall-effect sensor 44*b* is roughly at maximum when output signal 46*a* of Hall-effect sensor 44*a* inverts. In this way, control unit 45 detects the instant magnet 42, and therefore relative pocket 13 supporting magnet 42, is in detection position 41 only if it determines an inversion of output signal 46*a* of Hall-effect sensor 44*a* when output signal 46*b* of Hall-effect sensor 44*b* is roughly at maximum.

Preferably, tubular body 43 is made of nickel-plated brass, is filled with resin, and has a reference mark 47 on its outer surface indicating detection position 41; and permanent magnet 42 is cylindrical, is 5 mm in diameter and 10 mm long, and has a surface magnetic field strength of 0.3 to 0.5 tesla.

As stated, reading devices 38 and 40 are identical, so what has been said relative to the structure and operation of reading device 40 also applies to reading device 38. It should be pointed out, however, that, whereas magnets 42 are inserted in respective pockets 13 solely to allow reading device 40 to determine the position of pockets 13, the magnet 36 inside each rod 35 and used by respective reading device 38 to determine the position of rod 35 is an integral part of respective linear electric motor 32.

Reading devices 38 and 40 as described above are cheap and easy to produce, are totally unaffected by tobacco powder and therefore need no cleaning, and, at the same time, provide for optimum performance in terms of reading speed and precision. Moreover, an important point to note is that, as confirmed by tests, reading devices 38 and 40 as described above function correctly even in the event of variations in the distance between magnet 36 or 42 and tubular body 43 in a direction perpendicular to the travelling direction of magnet 36 or 42. More specifically, reading devices 38 and 40 function correctly up to 5–7 mm variations in the distance between magnet 36 or 42 and tubular body 43 in a direction perpendicular to the travelling direction of magnet 36 or 42. This characteristic is particularly useful in the case of reading devices 40, in that, as pockets 13 are fed along path P1 by forming conveyor 12, the position of pockets 13 in a direction perpendicular to path P1 may undergo random variations of 1–4 mm due to the structure and dimensions of forming conveyor 12.

What is claimed is:

1. An automatic machine (1) for processing articles (4), and comprising a conveyor (12; 31) which feeds the articles (4) along a path (P1; P2) in a given feed direction and has at least one movable member (13; 35); and a reading device (40; 38) for determining the position of the movable member (13; 35) along the path (P1; P2); the machine (1) being characterized in that the reading device (40; 38) cooperates with a magnet (42; 36) housed inside the movable member (13; 35) and positioned with its polar axis perpendicular to the feed direction, and comprises two linear Hall-effect sensors (44), arranged side by side parallel to the feed direction so as to have zero sensitivity in a direction parallel to the feed direction, and maximum sensitivity in a direction perpendicular to the feed direction; and a control unit (45) which detects the instant in which the movable member (13; 35) is in a definite detection position (41; 33) with respect to the reading device (40; 38) by determining the instant in which the output signal (46) of one of the Hall-effect sensors (44) inverts, and by using the output signal (46) of the other Hall-effect sensor (44) to enable detection of the instant in which the movable member (13; 35) is in the detection position (41; 33).

2. A machine (1) as claimed in claim 1, wherein the control unit (45) detects the instant in which the movable member (13; 35) is in the detection position (41; 33) with respect to the reading device (40; 38) by determining the instant in which the output signal (46*a*) of the Hall-effect sensor (44*a*) downstream with respect to the travelling direction of the movable member (13; 35) inverts.

3. A machine (1) as claimed in claim 1, wherein the control unit (45) detects the instant in which the movable member (13; 35) is in the detection position (41; 33) with respect to the reading device (40; 38) by determining the instant in which the output signal (46*b*) of the Hall-effect sensor (44*b*) upstream with respect to the travelling direction of the movable member (13; 35) inverts.

4. A machine (1) as claimed in claim 1, wherein the two Hall-effect sensors (44) are located such a distance apart that, when the output signal (46) of one of the Hall-effect sensors (44) inverts, the output signal (46) of the other Hall-effect sensor (44) is roughly at maximum.

5. A machine (1) as claimed in claim 4, wherein the control unit (45) only detects the instant in which the movable member (13; 35) is in the detection position (41; 33) with respect to the reading device (40; 38) by determining the instant in which the output signal (46) of one of the Hall-effect sensors (44) inverts, if, at the same instant, the output signal (46) of the other Hall-effect sensor (44) is roughly at maximum.

6. A machine (1) as claimed in claim 1, wherein the magnet (42; 36) is a permanent magnet.

7. A machine (1) as claimed in claim 6, wherein the permanent magnet (42) is cylindrical.

8. A machine (1) as claimed in claim 7, wherein the permanent magnet (42) is 5 mm in diameter and 10 mm long.

9. A machine (1) as claimed in claim 7, wherein the permanent magnet (42) has a surface magnetic field strength of 0.3 to 0.5 tesla.

10. A machine (1) as claimed in claim 1, wherein the reading device (40; 38) comprises a tubular body (43) housing the Hall-effect sensors (44) and having, on its outer surface, a reference mark (47) indicating the detection position (41; 33).

11. A machine (1) as claimed in claim 10, wherein the tubular body (43) is made of nickel-plated brass, also houses the control unit (45), and is filled with resin.

12. A machine (1) as claimed in claim 1, and for producing packets (2) of cigarettes; the conveyor (12) comprising a number of movable members (13), each of which is defined by a pocket (13) for housing a corresponding group (3) of cigarettes (4), and has a respective permanent magnet (42); the machine (1) comprising a hopper (10) parallel to and facing the path (P1), an extracting device (11) for extracting groups (3) of cigarettes (4) from a bottom portion of the hopper (10) and feeding the groups (3) of cigarettes (4) to respective pockets (13), and a control device (39) located along the path (P1) to check, for each pocket (13), the end fill of the cigarettes (4) inside the pocket (13); and the reading device (40) determining the position of the pockets (13) at a control station (14), so as to generate a sync signal (46) by which to synchronize the control device (39).

13. A machine (1) as claimed in claim 1, for producing packets (2) of cigarettes, and comprising a hopper (10); and an extracting device (11) for extracting groups (3) of cigarettes (4) from a bottom portion of the hopper (10), and which comprises at least one extracting body (31) movable along a straight path (P2) between a rest position (33) and an extraction position (34); the reading device (38) determining when the extracting body (31) is in the rest position (33).

14. A machine (1) as claimed in claim 13, wherein the extracting device (11) comprises a linear electric motor (32) for operating the extracting body (31), which linear electric motor (32) has a movable part (35) integral with the extracting body (31) and having a number of permanent magnets (36); the reading device (38) employing one of the permanent magnets (36) of the movable part (35) to determine the position of the extracting body (31).

* * * * *